US005689858A

United States Patent [19]

Hauner et al.

[11] Patent Number: 5,689,858

[45] Date of Patent: Nov. 25, 1997

[54] COMPRESSION BAR FOR A TEXTILE MACHINE DRAFTING DEVICE

[75] Inventors: Friedrich Hauner, Ingolstadt; Alfons Zehndbauer, Wettstetten, both of Germany

[73] Assignee: Rieter Ingolstadt Spinnereimaschinenbau AG, Ingolstadt, Germany

[21] Appl. No.: 617,262

[22] Filed: Mar. 18, 1996

Related U.S. Application Data

[63] Continuation of Ser. No. 164,482, Dec. 9, 1993, abandoned.

[30] Foreign Application Priority Data

Dec. 17, 1992 [DE] Germany ..... 42 42 722.3

[51] Int. Cl.[6] ..... D01H 5/60

[52] U.S. Cl. ..... 19/262; 19/236; 19/245

[58] Field of Search ..... 19/236, 244, 248, 19/249, 250, 251, 253, 258, 259, 280, 288, 290, 245, 262, 263, 264, 265

[56] References Cited

U.S. PATENT DOCUMENTS

| | | | |
|---|---|---|---|
| 3,192,573 | 7/1965 | Nutter et al. | 19/280 |
| 4,430,774 | 2/1984 | Bothner | 19/288 |
| 4,642,852 | 2/1987 | Turner et al. . | |
| 5,016,323 | 5/1991 | Wehrli et al. | 19/288 |
| 5,048,157 | 9/1991 | Wehrli | 19/288 |

FOREIGN PATENT DOCUMENTS 883823 12/1961 United Kingdom .

OTHER PUBLICATIONS

EPO Search Report with Translation.

Handbuch der Baumwollspinnerei, vol. II, 5th Ed., and Bernh. Friedr. Voight, Verlag Handwerk und Technik, p. 120, (II), Fig. F15, O. Johannsen.

VSM Prospectus of the Vouk Company at ITMA 1991.

Operating Instructions Draw Frame: RSB 851 (4135), SB 851 (4135) of Rieter Spinning Systems, Aug., 1990, pp. 24, 4.4.2.4, p. 25, Fig. 4, p. 26, Fig. 5.

*Primary Examiner*—C. P. Crowder
*Assistant Examiner*—Larry D. Worrell, Jr.
*Attorney, Agent, or Firm*—Dority & Manning, P.A.

[57] ABSTRACT

A compression bar for use in the main drafting zone of drafting rollers of the textile industry. The invention considerably reduces deposits on a compression bar. The fixed compression bar has a rectangular cross-section, with its narrow faces being rounded off. On the other hand, the compression bar is rotatably mounted about its longitudinal axis, whereby the compression bar has preferably a circular cross-section.

3 Claims, 3 Drawing Sheets

COMPRESSION BAR FOR A TEXTILE MACHINE DRAFTING DEVICE

This is a continuation of application Ser. No. 08/164,482 filed Dec. 9, 1993 now abandoned.

BACKGROUND OF THE INVENTION

The instant invention relates to a compression bar such as is used in the main drafting zone of drafting rollers in the textile industry.

The drafting rollers constitute the core of a draw frame. Textile fiber slivers are presented to the drafting rollers and drafting of the fiber slivers takes place therein. As it is drawn through the drafting zones, the fiber sliver is spread out into a fiber fleece and is again formed into a fiber sliver after leaving the last drafting zone. The extent of drafting must be adapted to the fiber sliver material, with the staple length being an important material parameter. The drafting equipment consists of a number of roller pairs placed one behind the other and creating drafting zones. Normal drafting rollers generally create a pre-drafting zone and a main drafting zone. To be able to draft textile fiber slivers with fibers of different staple lengths with the same drafting rollers, the distance between the nips of roller pairs can be adjusted. As the distances between nips is increased, special guidance is required in the main drafting field, at least for shorter fibers. This is done by means of the compression bar. The compression bar is a non-moving, fixed bar extending over the width of the drafting rollers. The compression rod deflects the fiber fleece away from its direction of movement.

In a known embodiment, the compression rod has a circular cross-section (Johannsen, O.; Handbuch der Baumwollspinnerei, vol. II, 5th edition, Bernh. Friedr. Voigt Verlag Handwerk und Technik, Berlin-Hamburg, page 120 (II), FIG. F15) or a semi-circular cross-section (VSM prospectus of the Vouk company at ITMA 1991). Also known is a compression bar with a rectangular cross-section, the face of which is in contact with the fiber fleece being rounded and the face away from the fiber fleece being formed by a plane surface sloped towards the longitudinal axis (Operating Instructions, draw frame: RSB 851 (4135), SB 851 (4135) of RIETER Spinning Systems of August 1990, page 24, 4.4.2.4, page 25, FIG. 4, page 26, FIG. 5).

Compression bars with a circular cross-section are also known. They have however the disadvantage that deposited fibers form laps on the compression bar which could disturb the fleece.

It has been shown that many deposits occur with the profiles of conventional compression bars. The deposits are fibers, dust and dirt particles, and finish. Since the compression bar touches the running fiber fleece and deflects it, the fiber fleece is compressed at the point of deflection. As a result deposits from the fiber fleece are deposited on the compression bar. If these deposits become compressed they fall on the fiber fleece and produce a jolt as they pass the exit roller pair, risking to influence the rotational speed ratio of the roller pairs to their detriment. It is however especially disadvantageous that these deposits are conveyed as far as into the sliver funnel and restrict or clog its cross-section. Fiber sliver transportation is affected and sliver quality is impaired.

The dropping of deposits from the compression bar unto the fiber fleece is intensified if the pneumatic aspiration is too weak or is disturbed on the drafting rollers.

As described below, the fiber fleece is also subjected to disadvantageous influence. A delimitation is formed on the compression bar between dirt deposit and dirt-free zone. After switching over to a batch with rougher fiber material, the dirt layer exerts a brake effect upon the surface of the fiber fleece. Surface drafting disturbances may occur.

OBJECTS AND SUMMARY OF THE INVENTION

It is a principal object of the invention to reduce deposits on a compression bar considerably. Additional objects and advantages of the invention may be learned from the following description, or may be obvious therefrom, or may be learned by practice of the invention.

The objects are attained on the one hand in that a compression bar with a different cross-section is used and is placed over the width of the drafting zone. The compression bar is placed in a defined position but is not itself movable. The compression bar has a rectangular cross-section, whereby its narrow faces are rounded. The rounding of the two faces is a semi-circular rounding. The core of the material is ordinary construction steel the surface of which has been quenched and hardened by being treated with boron. This results in a low-friction and wear-resistant surface. The compression bar can also be made of a ceramic material or of wear-resistant steel.

The cross-section of the compression bar according to the invention results in the advantage that much less deposits occur on the compression bar. The time between cleanings of the compression rod can be double the usual time required for conventional rods. The material costs for the compression bar can be lowered.

On the other hand the objects may be attained in that the compression bar is mounted so as to be capable of rotating around its longitudinal axis and has a circular cross-section. The compression bar pressing upon the fiber fleece is rotated around its longitudinal axis by the moving fiber fleece. As a consequence of this rotation of the compression bar, deposits on its surface are avoided. A self-cleaning effect is achieved without affecting the basic function. Soiling is effectively avoided with this simple design. Inspection and cleaning cycles for the compression bar may be omitted in principle.

DETAILED DESCRIPTION OF THE PREFERRED EMBODIMENTS

Reference will now be made in detail to the presently preferred embodiments of the invention, one or more examples of which are shown in the figures. Each figure is provided by way of explanation of the invention and not as a limitation of the invention. The numbering of components is consistent throughout the figures and description, with the same components having the same number throughout.

Figure 1:
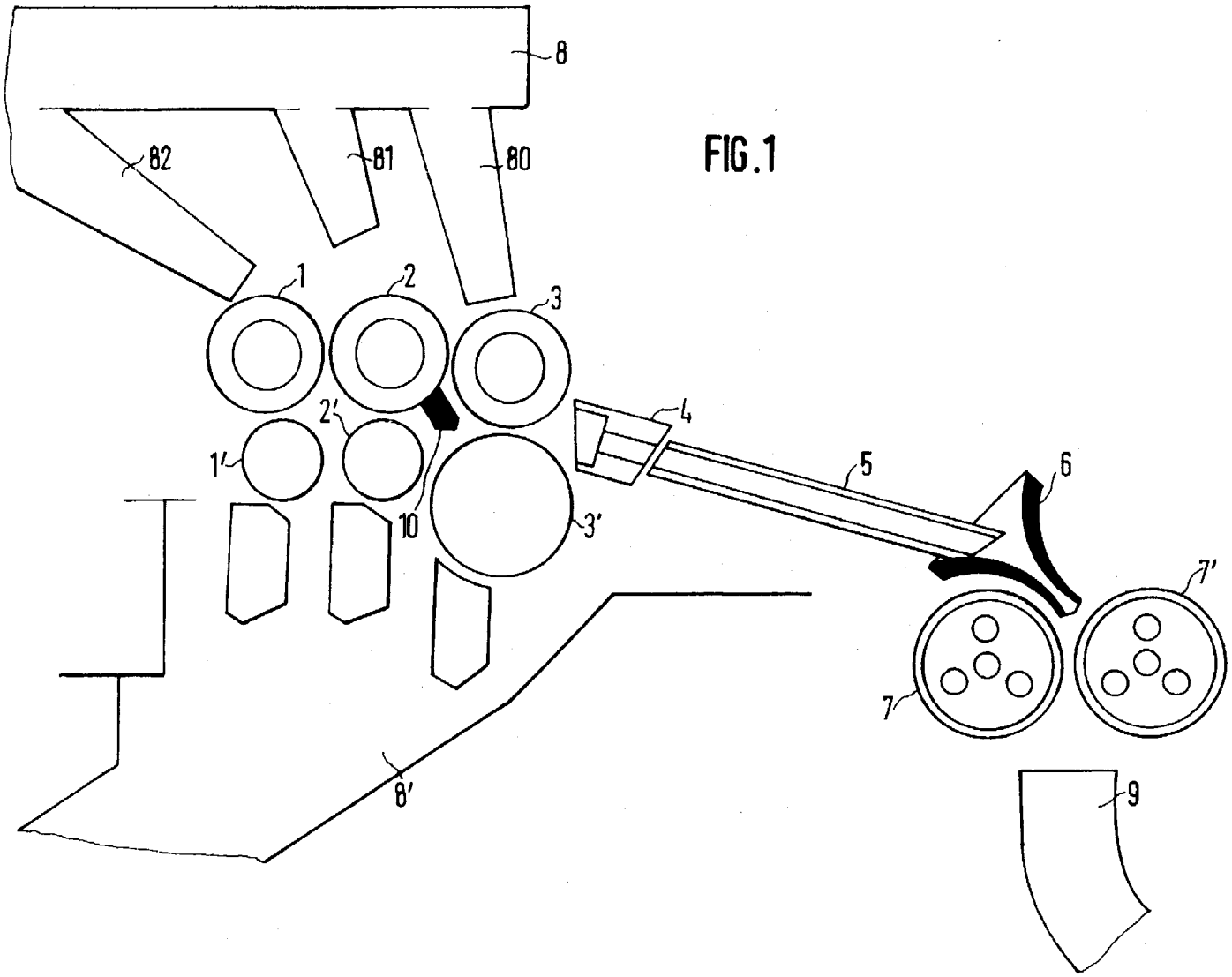
FIG. 1 shows a schematic cross-section of drafting rollers with a known compression bar.

FIG. 1 is a schematic depiction of drafting rollers such as are generally used in draw frames of the textile industry. The drafting rollers consist of three pairs of rollers. A forward roller pair 1, 1', a central roller pair 2, 2' and an exit roller pair 3, 3'. With these drafting rollers a compression bar 10 with a known cross-section is used. The drafting rollers are surrounded by a pneumatic suction system 8, 8'. Suction takes place above and below the drafting rollers. The upper pneumatic suction system 8 has 3 suction nozzles 80, 81, 82. The fiber sliver (not shown) runs through the drafting rollers, starting at the roller pair 1, 1' and is conveyed in the form of a fiber fleece into a fleece funnel 4. There it is folded into a fiber sliver and is conveyed on through a funnel pipe 5 into a sliver funnel 6 to the draw-off roller pair 7, 7'. The fiber sliver is conveyed from the draw-off roller pair 7, 7' into a rotating sliver guiding channel 9. This sliver guiding channel 9 is part of a rotary plate to receive the deposited fiber sliver.

The compression bar 10 is located in the main drafting zone. As is known, the compression bar is a fixed, unmovable bar which deflects the fiber fleece between the nips of the main drafting zone. In the present case, the compression bar is located above the fiber fleece. The compression bar is firmly screwed to its mount through thread bores 11, 11'. The mount is not described in further detail. The mount can be attached on the bearing of roller 2, for example. But it is also possible to install the compression bar beneath the fiber fleece.

The fiber fleece is deflected by the compression bar and is compressed at the point of deflection. Especially where fiber material with a short staple length is used, the short fibers are given additional guidance by this compression bar. This is always necessary when the distance between the nips of the roller pairs constituting the main drafting zone is increased. The compression bar is designed so that it reaches over the entire width of the drafting zone.

During draw-frame operation, particles or deposits occur on the compression bar. These deposits are of mineral dust, some short fibers, dirt and finish. These deposits become compressed or hardened and drop at undefined points in time upon the fiber fleece in the main drafting zone.

The falling of debris from the compression rod onto the fiber fleece is intensified when pneumatic suction is too weak or disturbed, for example. Such disturbance results, for example, from insufficient adjustment of the suction nozzle 80 over roller 3. If the suction nozzle 80 is placed too far forward, in the direction of roller 3, the problem of fiber fly slaved by roller 2 not being sufficiently sucked away but being deposited instead on the compression bar 10 arises.

Figure 2A:
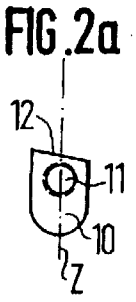
FIG. 2*a* is a view of the known compression bar.
Figure 2:
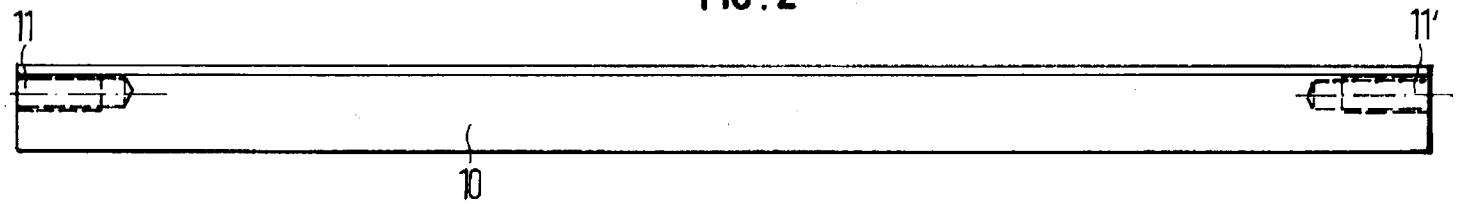
FIG. 2 is a view of the known compression bar.

FIG. 2 shows the compression bar 10 out of scale. FIG. 2*a* is a side view of the compression bar 10. Deposits occur especially on the plane surface 12 which is slightly sloped towards the vertical axis Z.

If the compacted deposits fall on the fiber fleece they may trigger an asynchronism in the rotational speed ratio of the drafting rollers due to an unwanted jolt towards the exit roller pair. It is furthermore a disadvantage that these deposits continue to be conveyed and especially that they may constrict the outlet of the sliver funnel 6. The transportation of the fiber sliver may be impaired by these deposits in the sliver funnel 6, so that the band quality suffers or clogging with dammed-up fiber sliver may result.

Figure 3A:
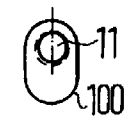
FIG. 3*a* is a view of a compression bar according to the invention.
Figure 3:
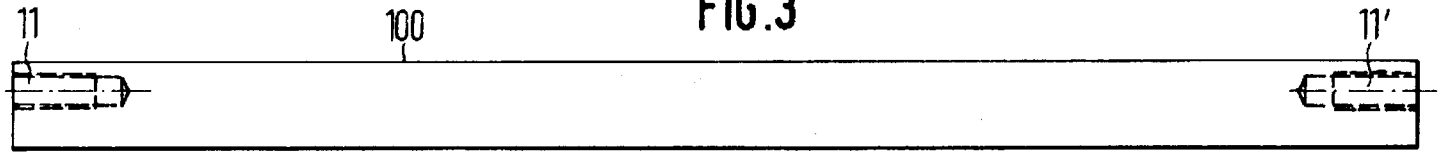
FIG. 3 is a view of a compression bar according to the invention.

In order avoid these disadvantages, a compression bar 100 (FIG. 3) with an altered profile (FIG. 3*a*) was used at the same location of the drafting rollers. The profile was designed to reduce the deposits to a minimum, so that their existence may not result in the impairment of the operation of any other working elements, such as sliver funnel 6 for example. The compression bar 100 has a rectangular cross-section according to the invention (FIG. 3*a*), with the narrow faces being rounded. It is a characteristic that the rounding of both faces is in the form of a semi-circle. The compression bar 100 is made of a low-friction and wear-resistant material. To achieve low-cost material utilization, the core of the compression bar 100 is made of ordinary construction steel with a surface that has been quenched and tempered by being treated with boron. The compression bar can however also be made of a ceramic material or wear-proof steel.

Figure 4:
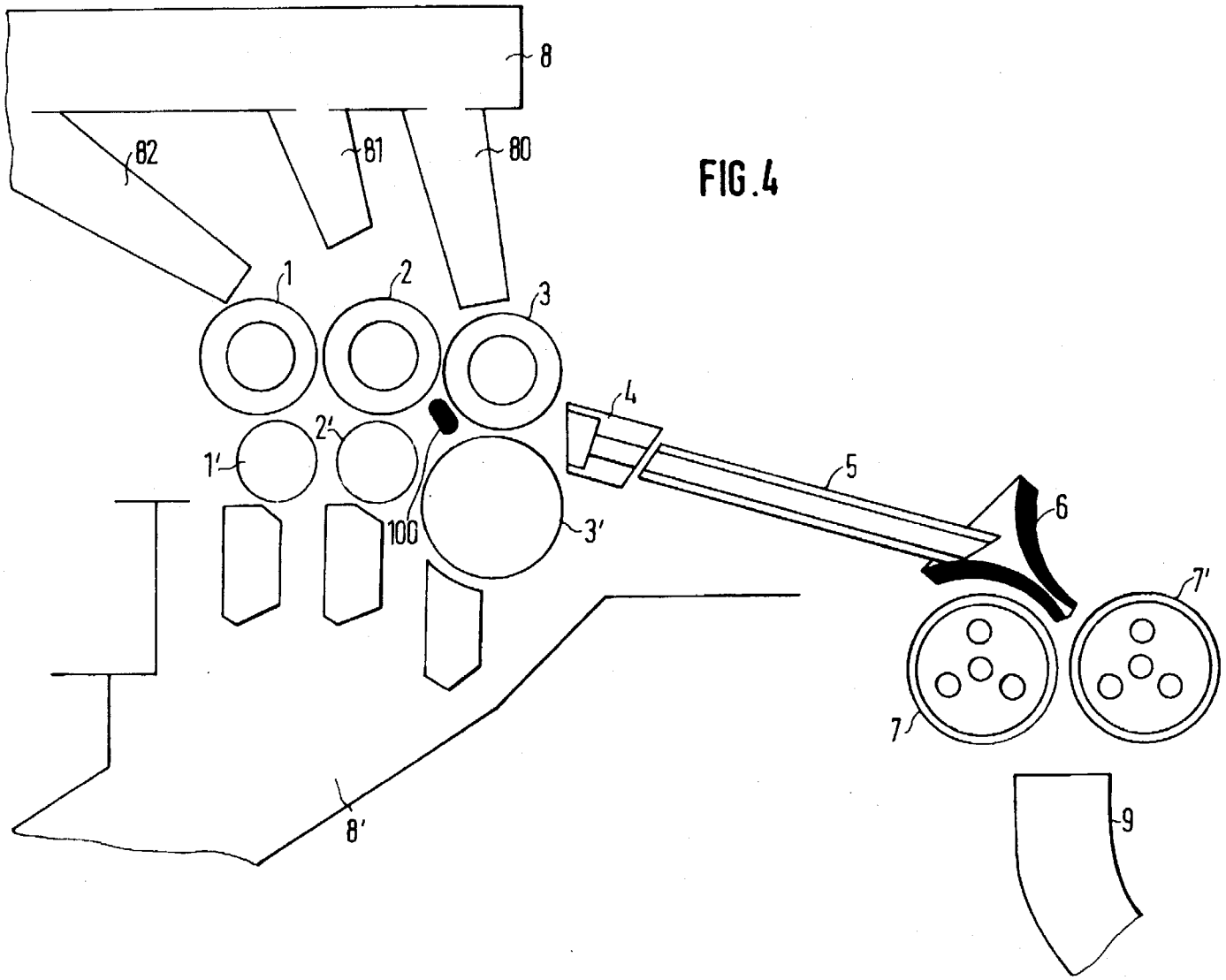
FIG. 4 is a schematic cross section of drafting rollers with a compression bar according to the invention.

FIG. 4 schematically shows drafting rollers with the compression bar 100 according to the invention. At high output speeds of approx. 800 m/min and utilization of a fiber sliver with high mineral dust and short-fiber content and with the narrowest drafting roller adjustment, the compression bar 100 makes it possible to considerably reduce the influence of deposits dropping from the compression rod on fiber sliver transportation and fiber sliver quality. The time span between cleanings of a compression bar can be doubled.

Figure 5:
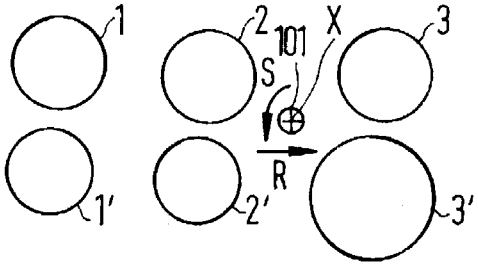
FIG. 5 shows a rotatably mounted compression bar.

Another solution of the problem is shown in the embodiment based on FIG. 5. It shows a compression bar 101 which is mounted rotatably around its longitudinal axis X. The longitudinal axis X is located above the fleece and at a right angle to the direction of movement R of the fiber sliver. Since the compression bar 101 is pressed against the fiber fleece, the fiber fleece moving in direction R transmits by means of friction a rotation to the compression rod 101 around its longitudinal axis X in direction of movement S.

The compression bar executes this rotational movement in direction S best if it has a circular cross-section. As a result of this rotation the entire circumference of the compression rod 101 comes into contact with the fiber fleece. This rotation of the compression rod 101 prevents the moving fiber fleece from bringing and depositing impurities.

The compression bar may have a diameter of approximately ten to twelve millimeters and is mounted on the sides with roller bearings. Each roller bearing is placed in a rigid mount which holds the compression rod 101 in a defined position relative to the fiber fleece.

It will be apparent to those skilled in the art that various modifications and variations can be made in the present invention without departing from the scope or spirit of the invention. For example, features illustrated as part of one embodiment may be used on another embodiment to yield a still further embodiment. It is intended that the present invention cover such modifications and variations as come within the scope of the appended claims and their equivalents.

We claim:

1. A drafting device for drafting a textile fiber silver, said device comprising:

a first set of drafting rollers and a second set of drafting rollers disposed directly adjacent and downstream from said first set of drafting rollers in a conveying path of said fiber silver;

a main drafting zone defined directly between said first and second sets of drafting rollers having a width corresponding essentially to the width of said drafting rollers wherein said fiber silver is conveyed between said sets of drafting rollers and drafted by said directly adjacent sets of drafting rollers in said main drafting zone; and a compression bar having a substantially circular cross-section operably disposed between said directly adjacent sets of drafting rollers across said width of said main drafting zone, said compression bar disposed above said conveying path of said fiber silver and rotatable about a longitudinal axis through said com pression bar to reduce contamination on said compression bar.

2. The drafting device as in claim 1, wherein said compression bar is formed of steel and comprises a low-friction wear resistant surface treated with boron.

3. The drafting device as in claim 1, wherein said compression bar is formed of a ceramic material.

* * * * *